US008795442B2

(12) United States Patent
Mukai et al.

(10) Patent No.: US 8,795,442 B2
(45) Date of Patent: Aug. 5, 2014

(54) HIGH-STRENGTH COLD ROLLED STEEL SHEET EXCELLING IN CHEMICAL TREATABILITY

(75) Inventors: Yoichi Mukai, Kakogawa (JP); Shinji Kozuma, Kakogawa (JP); Masahiro Nomura, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 854 days.

(21) Appl. No.: 12/162,878

(22) PCT Filed: Mar. 29, 2007

(86) PCT No.: PCT/JP2007/056887

§ 371 (c)(1),
(2), (4) Date: Jul. 31, 2008

(87) PCT Pub. No.: WO2007/114261

PCT Pub. Date: Oct. 11, 2007

(65) Prior Publication Data

US 2009/0014095 A1 Jan. 15, 2009

(30) Foreign Application Priority Data

Mar. 31, 2006 (JP) ..... 2006-098081

(51) Int. Cl.
*C22C 38/00* (2006.01)
*B32B 3/00* (2006.01)

(52) U.S. Cl.
USPC ..... 148/320; 428/687

(58) Field of Classification Search
CPC ..... C21D 9/46; C21D 8/0478
USPC ..... 148/320; 428/687
See application file for complete search history.

(56) References Cited

U.S. PATENT DOCUMENTS

| | | | | |
|---|---|---|---|---|
| 7,371,294 | B2 | 5/2008 | Miura et al. | |
| 2004/0244877 | A1 * | 12/2004 | Yokoi et al. | 148/320 |
| 2009/0032148 | A1 * | 2/2009 | Kozuma et al. | 148/330 |

FOREIGN PATENT DOCUMENTS

| | | | | |
|---|---|---|---|---|
| EP | 1375694 | A1 * | 1/2004 | C22C 38/18 |
| JP | 56 130475 | | 10/1981 | |
| JP | 62151208 | | 7/1987 | |
| JP | 02138489 | A * | 5/1990 | C23G 1/08 |
| JP | 5 320952 | | 12/1993 | |
| JP | 08257616 | * | 10/1996 | B21B 39/08 |

(Continued)

OTHER PUBLICATIONS

U.S. Appl. No. 12/303,566, filed Dec. 5, 2008, Nakaya, et al.

(Continued)

*Primary Examiner* — Keith Walker
*Assistant Examiner* — Alexander Polyansky
(74) *Attorney, Agent, or Firm* — Oblon, Spivak, McClelland, Maier & Neustadt, L.L.P.

(57) ABSTRACT

The invention provides a high strength cold rolled steel sheet having excellent chemical conversion treatment property stably even Mo is added aiming high strengthening. The surface property of the cold rolled steel sheet satisfies that the characteristic of 10 μm or more of the maximum depth (Ry) of the unevenness and 30 μm or less of the average spacing (Sm) of the unevenness, and that either one or more preferably both of, the characteristic of the load length ratio (tp40) of the unevenness of the surface is 20% or less, and the characteristic of the difference of the load length ratios (tp60) and (tp40) is 60% or more, is satisfied, and the crack of 3 μm or less width and 5 μm or more depth does not exist on the surface.

24 Claims, 2 Drawing Sheets

(56) References Cited

FOREIGN PATENT DOCUMENTS

| | | | | |
|---|---|---|---|---|
| JP | 2000 355775 | | 12/2000 | |
| JP | 2002 226944 | | 8/2002 | |
| JP | 2005 187863 | | 7/2005 | |
| KR | 10-0470652 | | 3/2005 | |
| KR | 10-0530071 | | 11/2005 | |
| WO | 2006 106847 | | 10/2006 | |
| WO | WO 2006106847 | * | 10/2006 | ..... C22C 38/58 |

OTHER PUBLICATIONS

U.S. Appl. No. 12/303,634, filed Dec. 5, 2008, Nakaya, et al.
U.S. Appl. No. 11/908,616, filed Sep. 14, 2007, Miura et al.
U.S. Appl. No. 11/910,029, filed Sep. 28, 2007, Akamizu, et al.
U.S. Appl. No. 11/910,013, filed Sep. 28, 2007, Kashima, et al.
Office Action issued Oct. 20, 2010, in Korean Patent Application No. 10-2008-7023867 with English language translation.

* cited by examiner (a) IN THE CASE OF WATER COOLING (b) IN THE CASE OF WATER COOLED ROLL HEAT REDUCTION, GAS JET,MIST COOLING

HIGH-STRENGTH COLD ROLLED STEEL SHEET EXCELLING IN CHEMICAL TREATABILITY

TECHNICAL FIELD

The present invention relates to a cold rolled steel sheet having high strength and excellent in the property of the chemical conversion treatment such as phosphate treatment.

BACKGROUND ART

Recently, from viewpoint of improvement of fuel economy accompanying weight reduction and reduction of exhaust gas of automobiles and the like, further higher strengthening of a steel is required, and with regard, particularly, to a cold rolled steel sheet, hi-ten-ization (high strengthening) has been progressing rapidly. To effect high strengthening by adding alloy elements is common against such a requirement, however, there comes up a problem that chemical conversion treatment property lowers if adding amount of alloy elements is increased. Mo, among them, is commonly used as an element to increase the strength because ductility reduction is little although it has a high effect in increasing the strength. However, if Mo is added to steel, a new problem comes up that natural potential of the steel sheet in the chemical conversion treatment liquid gains to noble direction and chemical conversion treatment property is extremely deteriorated.

So, several methods are also proposed to improve chemical conversion treatment property while the aim of increasing the strength by adding alloy elements being satisfied.

In the patent document 1, for example, a method to improve chemical conversion treatment property by controlling the regulation degree parameter representing the regularity of the roughness of the steel sheet surface to 0.25 or less is disclosed. The object of the control in this case is that of 340 MPa class or below belonging to a low-carbon Al-killed steel, and this technology scarcely exerts its effect for Mo-added steel which the present invention attends to in particular. Also, to secure a high strength steel sheet, utilization of alloy elements having a strengthening action such as Si and Mn becomes a useful measure. However, those alloy elements generate surface oxide in the annealing process after cold rolling, therefore chemical conversion treatment property cannot be improved by adjusting the regulation degree parameter of the roughness of the surface only, as far as the surface oxide is not controlled.

Also, in the patent document 2, lowering of chemical conversion treatment property is prevented by forming an iron coat of approximately 20-1,500 mg/m$^2$ on the surface of the high strength cold rolled steel sheet and inhibiting the influence of the alloy element densified on the steel sheet surface and the selective oxidation layer. However, in this method, an electric plating process becomes necessary to form the iron coat, and problems of productivity and cost come up.

On the other hand, the present inventors developed a technology to effectively utilize the oxide generated on the steel sheet surface as a generating site of nuclei of phosphate crystal by controlling the shape of the oxide and to improve chemical conversion treatment property, and proposed previously as the patent document 3.

Patent document 1: JP-A-62-151208
Patent document 2: JP-A-5-320952
Patent document 3: JP-A-2005-187863

DISCLOSURE OF THE INVENTION

Problems to be Solved by the Invention

Under the situations as described above, the present invention aims to provide the high strength cold rolled steel sheet as is capable of exerting excellent chemical conversion treatment property stably even in the cold rolled steel sheet with Mo being added aiming high strengthening, as well as in the high strength cold rolled steel sheet with Mo not being included.

Means to Solve the Problems

The high strength cold rolled steel sheet in relation with the present invention which could solve the problems described above is the high strength cold rolled steel sheet excellent in chemical conversion treatment property having the tensile strength of 390 MPa or above, for example, and 780 MPa level or above, wherein:

the required conditions of the maximum depth (Ry) of the unevenness existing on the surface of the steel sheet of 10 μm or more and the average spacing (Sm) of the unevenness of 30 μm or less are satisfied; out of two required conditions 1) the load length ratio of surface unevenness (tp40) to be 20% or less, and
2) the difference between the load length ratios (tp60) and (tp40) of surface unevenness to be 60% or more, either one required condition is satisfied, more preferably, these required conditions of 1), 2) are satisfied simultaneously; and further, cracks of the width of 3 μm or less and the depth of 5 μm or more existing on the surface do not exist.

The constituent component of the steel sheet described above in relation with the present invention can be changed optionally with response to the required strength, which preferably is steel satisfying, C:0.05-1.0%, Si:2% or below, Mn:0.3-4.0%, Al:0.005-3.0% as a basic component, preferably further including Mo:0.02-1.0% for high strengthening, or, if needed, further containing at least one kind of element selected from a group consisting Cr:1.0% or less, Ti:0.2% or less, Nb:0.1% or less, V:0.1% or less, Cu:1.0% or less, Ni:1.0% or less, B:0.002% or less, Ca:0.005% or less, and the balance comprising iron with inevitable impurities.

Also, the strength level of the high strength cold rolled steel sheet in relation with the present invention cannot be decided uniformly because it changes according to the use and the purpose, but the common strength level is that having the tensile strength of 390 MPa or above, more preferably 780 MPa or above. The preferable metal structure of the steel sheet satisfying such strength level and chemical conversion treatment property is a) one having two-phase structure of ferrite and tempered martensite, and b) one having complex structure of 5-80 area % of ferrite, 5-80 area % of bainite, with total amount of ferrite and bainite being 75 area % or more, and retained austenite being 5 area % or more.

Effects of the Invention

According to the present invention, chemical conversion treatment property can be remarkably improved by stipulating the maximum depth (Ry) of unevenness existing on the surface of the cold rolled steel sheet and the average spacing (Sm) of the unevenness and stipulating the load length ratio (tp40) of the unevenness of the surface and/or the difference between the load length ratios (tp40) and (tp60), further by specifying the width and the depth of cracks, excellent chemical conversion treatment property is assured even in not only the cold rolled steel sheet not containing Mo but in the high strength cold rolled steel sheet with Mo, which deteriorates chemical conversion treatment property, being contained by an appropriate amount for high strengthening, and the cold rolled steel sheet having both strength and chemical conversion treatment property can be provided at low cost.

BEST MODE FOR CARRYING OUT THE INVENTION

Under the problems to be solved such as those described above, the present inventors have diligently proceeded with the research to improve the problem of deterioration of chemical conversion treatment property by Mo addition, with the object of the cold rolled steel sheet in particular to which Mo was added as a measure of high strengthening.

As a result of it, it was found out that, if the maximum depth (Ry) of the unevenness of the surface of the cold rolled steel sheet was specified as "10 μm or more" and the average spacing (Sm) of the unevenness was specified as "30 μm or less", and the load length ratio (tp40) of the unevenness of the surface was adjusted to 20% or less, and/or the difference of the load length ratios of the unevenness (tp60) and (tp40) [(tp60)−(tp40)] was adjusted to 60% or more, and further, the width and the depth of a crack existing on the surface were specified, deterioration of chemical conversion treatment property was inhibited even in not only the cold rolled steel sheet not containing Mo but in the cold rolled steel sheet with an appropriate amount of Mo being added aiming further high strengthening, and the cold rolled steel sheet having both excellent chemical conversion treatment property and strength could be secured.

Figure 1:
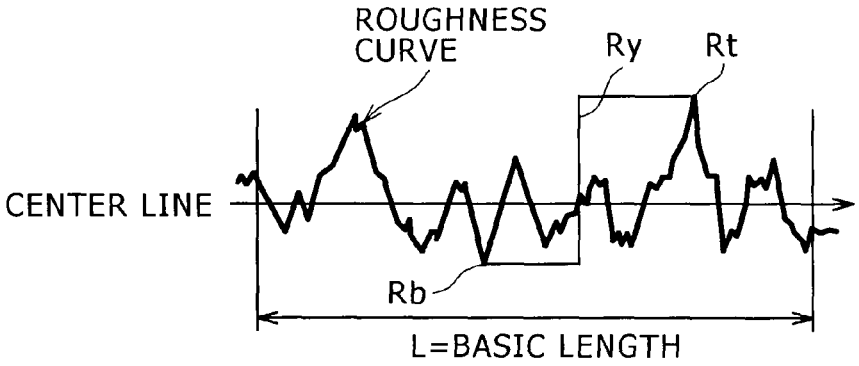
FIG. 1 The drawing to explain the definition of the maximum depth (Ry) of the unevenness existing on the surface of the steel sheet.
Figure 2:
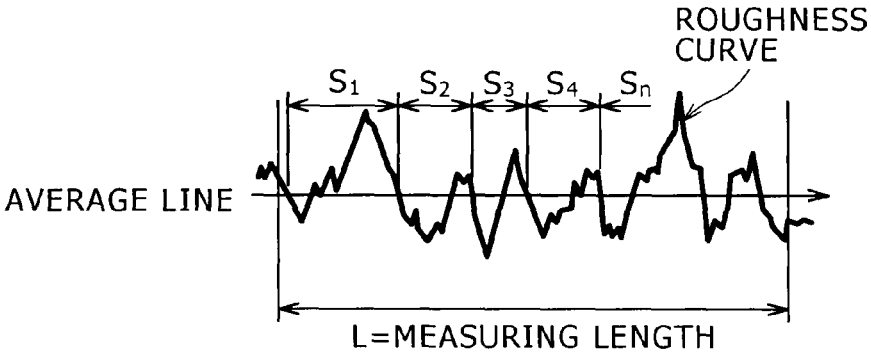
FIG. 2 The drawing to explain the definition of the average spacing (Sm) of the unevenness existing on the surface of the steel sheet.
Figure 3:
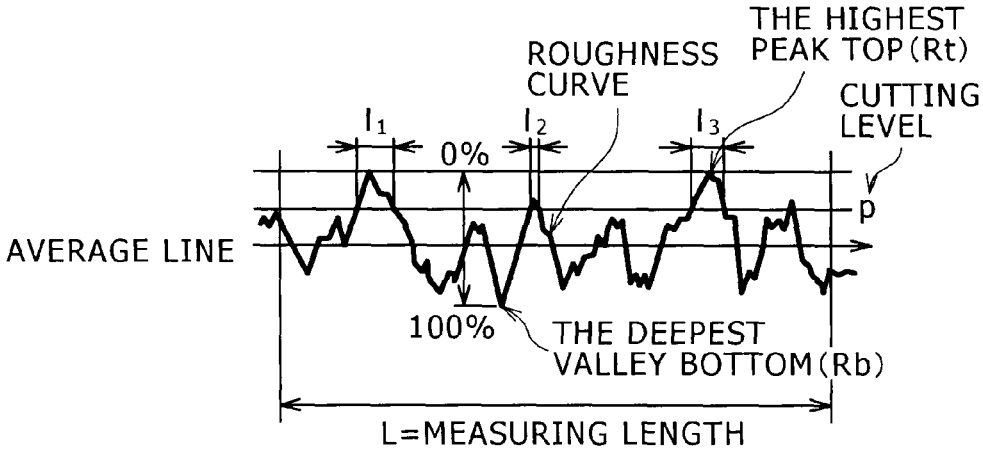
FIG. 3 The drawing to explain the definition of the load length ratios (tp40), (tp60) of the unevenness existing on the surface of the steel sheet.

The maximum depth (Ry) described above of the unevenness of the surface stipulated in the present invention means the spacing between the highest peak top (Rt) and the deepest valley bottom (Rb) of the surface roughness curve as is exemplarily exhibited in FIG. 1, and the average spacing (Sm) of the unevenness means, letting the point where the average line in the surface roughness curve turns from a mountain to a valley be a changing point as is exemplarily exhibited in FIG. 2, the average value of the spacing from a changing point to the next changing point ($S_1, S_2 \ldots S_N$). Also, the load length ratio [profile bearing length ratio] (tp) means the percentage of the cut part length ($l_1, l_2 \ldots l_n$) when the surface roughness curve is cut at a certain cutting line level (p) against the measuring length (L), as is exemplarily exhibited in FIG. 3, and one wherein the cut line level (p) described above is the highest peak top (Rt) is 0 (zero) and shown as (tp0), and one wherein the same is the deepest valley bottom (Rb) is 100 and shown as (tp100). Further, the percentage of the cut part length ($l_1+l_2+l_3+\ldots l_n$) described above when the cutting line level (p) is "40" or "60" against the measuring length (L) is the value shown as (tp40) or (tp60).

And it was confirmed that one, with the maximum depth (Ry) of the unevenness of the surface described above was "10 μm or more", the average spacing (Sm) was "30 μm or less", and the load length ratio of the unevenness of the surface (tp40) described above was 20% or less, and/or the difference of the load length ratios (tp60) and (tp40) [(tp60)−(tp40)] was 60% or more, and further, the crack of 3 μm or less width and 5 μm or more depth did not exist on its surface, showed excellent chemical conversion treatment property stably, even if it was not only the steel not containing Mo but also the cold rolled steel sheet containing appropriate amount of Mo.

In the present invention, it is considered that as the maximum depth (Ry) of the unevenness of the surface is relatively deep and the average spacing (Sm) of the unevenness is relatively small as described above, the unevenness of the surface is fine and deep and the function as a nuclei forming site of zinc phosphate crystal is enhanced, zinc phosphate crystal becomes easily formed and grown in the whole face, and chemical conversion treatment property is enhanced.

Also, "20% or less" (that is, relatively small) of the load length ratio (tp40) of the unevenness of the surface described above means that the region (area) of the recessed concave part is relatively more than that of the convex part projected to the surface, the concave part becomes the nuclei forming site of zinc phosphate crystal and promotes formation and growth of zinc phosphate crystal similarly, and further, "60% or more" of the difference of the load length ratios (tp60) and (tp40) [(tp60)−(tp40)] described above (that is, the difference of tp60 and tp40 is relatively large) indicates that the slope extending from the top part of the convex part to the bottom part of the concave part has not the straight shaped slant face toward the bottom part direction but is recessed in a curved shape, the slant face part recessed in the curved shape promotes formation and growth of zinc phosphate crystal by functioning as a crystal depositing site, and it is considered that the above contributes to further improvement of chemical conversion treatment property.

In addition, in the present invention, as further other surface property of the surface of the steel sheet, it is necessary that the crack of 3 μm or less width and 5 μm or more depth does not exist. This crack is what is confirmed by observing the sectional face near the surface of the steel sheet at optional 10 fields of view by SEM photograph by 2,000 times, and if such a sharp crack exists on the surface of the steel sheet, zinc phosphate crystal becomes hard to be attached to the portion during chemical conversion treatment, and securing of satisfactory chemical conversion treatment property becomes impossible. Consequently, non-existence of the sharp crack of the width and depth as described above becomes an important required condition in securing excellent chemical conversion treatment property.

Anyway, in the present invention, as will be disclosed in the example described below, excellent chemical conversion treatment property could be secured stably by, in addition to setting the maximum depth (Ry) of the unevenness of the surface described above as "10 μm or more" and the average spacing (Sm) as "30 μm or less", by stipulating the load length ratio (tp40), which had not been recognized at all from the viewpoint of chemical conversion treatment property so far, as "20% or less", and/or the difference of the load length ratios (tp60) and (tp40) [(tp60)−(tp40)] as "60% or more", and further, by stipulating the crack of 3 μm or less width and 5 μm or more depth was not to exist.

What is more preferable for improving chemical conversion treatment property is the one wherein the average spacing (Sm) is 20 μm or less, the load length ratio (tp40) is 15% or less, the difference of the load length ratios [(tp60)−(tp40)] is 70% or more, and the crack of 3 μm or less width and 5 μm or more depth does not exist. Also, although the value of the load length ratio (tp60) is not specifically stipulated, for improving chemical conversion treatment property, it is preferably 60% or more, more preferably 70% or more.

By securing the surface property as described above, phosphate crystal deposited on the surface of the steel sheet by chemical conversion treatment becomes more fine one, and P ratio, that is the ratio of Phosphophyllite (P) and Hopeite (H) (P/P+H), which is an index of the soundness of phosphate, gets more closer to 1, and chemical conversion treatment property improves. Also, in Mo added steel, although chemical conversion treatment property deteriorates because the natural potential in the chemical conversion treatment liquid gains to noble direction, by securing such surface property as described above, excellent chemical conversion treatment property, more than made up for deterioration of chemical conversion treatment property by Mo, can be secured.

Although the method for securing the cold rolled steel sheet of the surface property as described above is not particularly limited, according to the experiment of the present inventors, it has been confirmed that it was possible to getting close to the surface property described above by performing strong acid pickling after annealing.

For a cold rolled steel sheet, while there is a case acid pickling is not performed being left as it is after annealing, there is also a case acid pickling is performed to remove oxide formed on the surface of the steel sheet during heating and water quenching. Although the acid pickling of the case is performed usually using hydrochloric acid aqueous solution of approximately 3-7 wt % at approximately 40-80 degree C. for approximately 5-20 seconds, to secure the surface property described above which the present invention intends, it can be accomplished by setting the density of hydrochloric acid of acid pickling liquid rather high, the acid pickling temperature rather high, or the acid pickling time rather long. More specifically, it has been confirmed that, when hydrochloric acid density of acid pickling liquid is made A (%), acid pickling temperature is made B (degree C.), acid pickling time (dipping time) is made C (second), if controlled so that these satisfy the relation of equation (I) below $$\left(\frac{A}{100}\right)\times B^2\times C \geq 14000 \quad \text{(I)}$$

(for example, 11% HCl-80 degree C.-30 seconds, 15% HCl-80 degree C.-20 seconds, 16% HCl-85 degree C.-15 seconds, and the like), the surface property as described previously becomes easily secured.

Further, although the sharp crack generated on the surface of the steel sheet is considered to be generated by acid resolving or mechanical dropping out of a linear compound including a Si oxide formed during hot rolling and continuous annealing, it has been confirmed that if acid pickling was performed in the strong acid pickling condition as described above, the unevenness of the surface was relaxed and the sharp cracks inhibiting chemical conversion treatment property almost disappeared.

Because this steel sheet is excellent in chemical conversion treatment property, it is especially suited to use of the structural parts of automobiles wherein the steel sheet containing alloy elements much is used. It is suitably used for vehicle body constituting parts such as, for example, a side member of front and rear part and a colliding part such as a crash box and the like, as well as pillar kinds such as a center pillar reinforce and the like, a roof rail reinforce, side sills, a floor member, kick parts.

Next, the reasons preferable composition of the steel used in the present invention was stipulated are as described below.

C: 0.05-1.0%

C is an important element in improving the stress of cold rolled steel sheet, and if it is below 0.05%, major part of C is dissolved into ferrite, therefore formation of carbide (basically cementite, which is a carbide of iron, or carbide of Nb, Ti, V and the like possibly added according to necessity) contributing to high strengthening is insufficient, and the strength of the level the present invention intends becomes hard to be secured. However, if it is excessive, not only forming workability is deteriorated but also adverse influence appears in welding performance, therefore it is desirable to control to 1.0% or less at maximum, more preferably 0.23% or less.

Si: 2.0% or Less (Inclusive of 0%)

Si, not only acts effectively as a deoxidizing element in melting steel, but also is effective in promoting concentration of carbon into austenite, making austenite be retained at room temperature and securing excellent strength-ductility balance. To make such actions exert effectively, it is desirable to contain Si by 0.1% or more, preferably 0.5% or more. However, if Si content becomes excessive, solid solution strengthening action becomes conspicuous and rolling load increases. Also, surface defect becomes easy to occur, and further, adverse influence appears in acid pickling performance and painting performance, therefore it is desirable to control to 2.0% or less at maximum, preferably 1.5% or less.

Mn: 0.3-4.0%

Mn, is an important element not only in having an effect to enhance strength but also in fixing S, which is mixed in steel and becomes an embrittlement factor, as MnS. To make these actions exert effectively, it is desirable to contain at least 0.3% or more, preferably 0.5% or more. But if it is excessive, not only ductility is deteriorated and workability is adversely influenced but also welding performance is deteriorated, therefore it is desirable to control to 4.0% or less at maximum, preferably 2.5% or less.

Al: 0.005-3.0%

Al is an element having deoxidizing action, and it is necessary to add Al of 0.005% or more when Al deoxidation is performed. If below it, deoxidation is insufficient, oxide-based inclusions such as MnO, $SiO_2$ and the like are formed much, and local deterioration of workability is caused. Also, similar to Si, Al acts effectively in promoting concentration of carbon into austenite and making austenite at room temperature be retained, and securing excellent strength-ductility balance. To make these effects exert effectively, it is desirable to contain Al at least 0.005% or more, preferably 0.01% or more, more preferably 0.2% or more. However, if Al content is excessive, not only the effects described above are saturated, but also embrittlement of steel and cost increase are incurred, therefore it is desirable to control to 3.0% at maximum, preferably 2.0% or less.

Al+Si: 1.0-4.0%

As described above, in the present invention, both Si and Al have an action to promote retaining of austenite at room temperature and to improve strength-ductility balance, therefore, to make the characteristics derived from metal structure aspect to be described later exert more effectively, it is desirable to contain Si and Al in total by 1.0% or more, more preferably 1.2% or more. However, if total of them is excessive, steel becomes to show embrittlement tendency, therefore it is preferable to control to at maximum 4.0% or less in total, preferably 3.0% or less.

Mo: 1.0% or less

Mo is an important element in advancing high strengthening of a cold rolled steel sheet by solid solution enhancement, and its effect is exerted effectively by containing 0.02% or more. However, in the case the required strength is below 500 MPa level, Mo is not necessarily be made to be contained. Mo amount depends on required strength level of a cold rolled steel sheet, but is 0.05% or more to exert its effect more certainly. However, if exceeding 1.0%, adverse influence given to ductility (workability) is conspicuous to higher degree than contributing to high strengthening and strength-elongation balance sharply deteriorates, therefore upper limit was set to 1.0%. It is desirable to control to more preferably 0.5% or less. Further, as was described previously, although the present invention has the largest feature in that chemical conversion treatment property deteriorating by addition of Mo is made up for by improvement of the surface property, chemical conversion treatment property improving effect by the surface property is effectively exerted even in high strength cold rolled steel sheet not containing Mo.

The constituting elements of the steel used in the present invention are as described above, and the balance substantially is Fe. Here, "substantially" means that containing of inevitable impurity element possibly mixed in the steel material or its production process is allowed, or that other elements may further allowed to be contained by a small amount as far as it does not inhibit action effects of each component element described previously. With regard to such inevitable impurity elements, P, S, N, O and the like can be exemplarily given, and with regard to other elements, Cr, Ti, Nb, V, Cu, Ni, B, Ca and the like are exemplarily exhibited. However, if excessive, these elements more or less deteriorate ductility and surface property, and exert adverse influence on chemical conversion treatment property, therefore they should be controlled to 1.0% or less Cr, 0.2% or less Ti, 0.1% or less Nb, 0.1% or less V, 1.0% or less Cu, 1.0% or less Ni, 0.002% or less B, 0.005% or less Ca respectively.

Also, the strength of the cold rolled steel sheet in relation with the present invention can be adjusted to optional strength of 390 MPa level or above, or further 780 MPa level or above, by changing the percentage content of C, Si, Mn, Mo and the like according to usage.

In addition, in case the cold rolled steel sheet of 780 MPa class or above is required, it is preferable, to slowly cool down to a predetermined ultimate slow cooling temperature (occasionally called quenching starting temperature, usually 350-750 degree C.) after heating to a temperature above $Ac_1$ transformation point in continuous annealing after cold rolling, thereafter to perform quenching by a variety of methods (water cooling, gas blowing, cooling by water cooled roll heat reduction, mist cooling, and the like), and further to perform tempering treatment at a temperature of approximately 150-550 degree C., thereby the metal structure to be made a two-phase structure of ferrite-tempered martensite. The preferable content ratio of the two-phase structure is in the range of ferrite: 5-95%, tempered martensite: 5-95% in terms of percentage of area occupying in the longitudinal cross-sectional structure.

Alternately, it is desirable, to use steel material whose steel constitution satisfies Si: 0.1-2.0%, Al: 0.01-3.0% and (Si+Al) being 1.0-4.0%, to cool down, after heating to a temperature above $Ac_1$ transformation point in continuous annealing after cold rolling, to a predetermined ultimate slow cooling temperature (150-600 degree C., for example), and to hold in the temperature range for approximately 60 seconds or more, thereby to make complex structure comprising ferrite-bainite-retained austenite.

The preferable content ratio of ferrite, bainite, retained austenite in the case of the complex structure, in terms of percentage of area occupying in the longitudinal cross-sectional structure likewise, is in the range of ferrite: 5-80% (preferably 30% or more), bainite: 5-80% (preferably 50% or less), retained austenite: 5% or more. It is preferable that the total content of ferrite and bainite is made to 75% or more, more preferably 80% or more, and its upper limit is controlled by the balance with the retained austenite amount.

Also, "ferrite" described above means polygonal ferrite, that is, ferrite of low dislocation density, and is the structure contributing particularly to ductility, whereas bainite is the structure contributing particularly to strength, and for balancing strength and ductility, the metal structure described above becomes to have an important meaning in the present invention.

The present invention is constituted as above, whereby it has become possible that chemical conversion treatment property has been improved with a high strength cold rolled steel sheet being made to an object, particularly that, even in the high strength cold rolled steel sheet added with Mo, which is useful as a strengthening element, deterioration of chemical conversion treatment property, that had been pointed out as a practical problem accompanying addition of Mo, has been prevented by appropriately controlling the surface property, and that cold rolled steel sheet having both high strength and excellent chemical conversion treatment property has been provided.

EXAMPLE

Although the present invention will be explained below further specifically referring to examples, the present invention intrinsically is not to be limited by the examples below, and can of course be implemented with modifications added appropriately within the scope adaptable to the purposes described previously and later, and any of them is to be included within the technical range of the present invention.

Example

Figure 4:
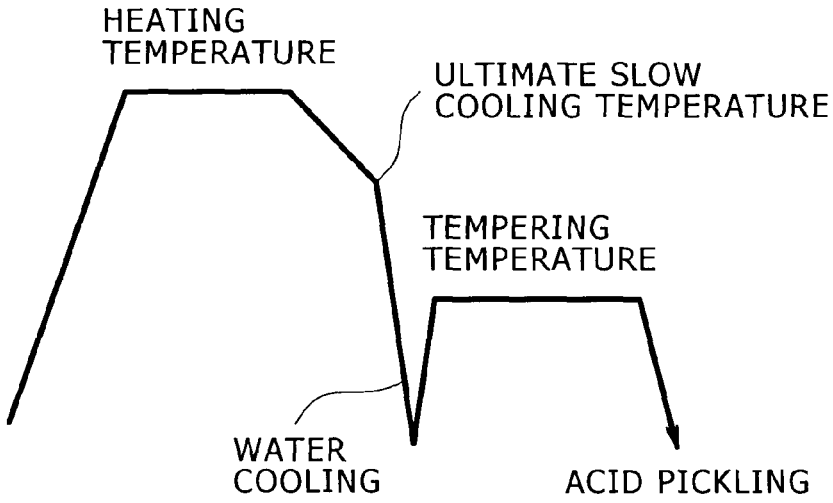
FIG. 4 The drawing to exhibit the outline of the heating quenching and tempering heat pattern before acid pickling adopted in the experiment.
Figure 4:
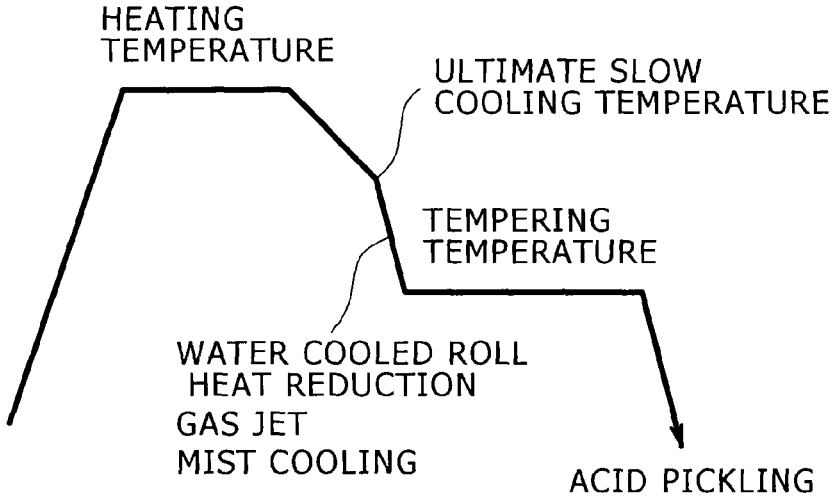

Steel 1-29 of chemical component exhibited in Table 1 exhibited below was molten and slab was produced by casting. After this slab is heated to a temperature of $Ac_3$ point or above, is hot rolled to 3.2 mm thickness under the condition exhibited in Table 2, and cold rolled to 1.4 mm thickness after acid pickling. Then, cold rolled steel sheet was obtained by performing acid pickling treatment under the condition exhibited in Tables 3, 4 after heating and annealing. A summary of the heat patterns adopted in this experiment is exhibited in FIGS. 4 (*a*), (*b*).

The mechanical properties and observation results of the longitudinal cross-sectional structure of the cold rolled steel sheets obtained were both exhibited in Table 2. Also, with regard to the cross-sectional structure, identification and area rate of the structure were obtained by observation using an optical microscope at the magnification of 1,000 times after repeller corrosion of the longitudinal cross-section of the sample steel sheets. Also, retained austenite (γ) was obtained by X-ray diffraction (XDR).

The surface property of each cold rolled steel sheet obtained was observed by a laser microscope (made by Lasertec Corporation, Model "1LM21W") using an objective lens of 50 times, the average spacing (Sm), the maximum depth (Ry), the values of the load length ratio (tp40) and (tp60) and its difference of the unevenness of the surface was obtained on 10 spots selected at random by scanning the area of 0.16 mm×0.22 mm per one spot, presence or absence of cracks on the surface of each sample by the method described below was confirmed, and further, chemical conversion treatment property was evaluated by the method described below. The results are exhibited together in Tables 3, 4.

Confirmation of Cracks:

Optional 10 fields of view (one field view: 13 cm×11 cm in the image of 2,000 times) near the surface of the sample steel sheet cross-section were observed by 2,000 times magnification using a SEM (Model "S-4500" made by Hitachi, Ltd.), and presence or absence of cracks of 3 μm or less width and 5 μm or more depth was examined.

Chemical Conversion Treatment Property:

After chemical conversion treatment is performed on the surface of each sample steel sheet under the condition described below, the steel sheet surface was observed by a SEM by 1,000 times, the attaching condition of zinc phosphate crystal on 10 fields of view selected at random was examined, and chemical conversion treatment property was evaluated by the criteria described below.

Chemical conversion treatment liquid . . . used the chemical conversion treatment liquid "Palbond L3020" made by Nihon Parkerizing Co., Ltd.

Chemical conversion treatment process . . . degreasing (45 degree C. for 120 seconds, using degreasing liquid "Finecleaner" made by Nihon Parkerizing Co., Ltd.)→water washing (30 seconds)→surface conditioning (dipping for 15 seconds in the surface conditioning liquid "Prepalene Z" made by Nihon Parkerizing Co., Ltd.)→chemical conversion treatment (dipping at 43 degree C. for 120 seconds in the chemical conversion treatment liquid described above)

Criteria

Lack of Hiding:

One attached homogenously in all 10 fields of view: ◎, one wherein number of field of view in which 5% or less of lack of hiding is observed is 3 or less fields of view out of 10 fields of view: (○), others: (x).

Particle diameter: 10 numbers of large ones are selected from each field of view and evaluated by average diameter of them.

10 μm or more: x,

7 μm or more—less than 10 μm: ○,

4 μm or more—less than 7 μm: ◎, less than 4 μm: ●.

P ratio: The peaks corresponding to Phosphophyllite (p) and Hopeite (H) on the steel sheet surface after chemical conversion treatment are measured by X-ray diffraction, and is evaluated by its ratio (P/P+H)(average value of n=5). In terms of P ratio=P/(P+H), less than 0.85: x, 0.85 or more—less than 0.93: ○, 0.93 or more—less than 0.96: ◎.

0.96 or more: ●.

Based on lack of hiding and particle diameter as well as P ratio described above, judgment was totally evaluated as described below.

One with lack of hiding is ◎, particle diameter is ●, P ratio is ● is ● (best) in total, one with lack of hiding is ◎, particle diameter and P ratio are ◎ or above and other than those described above, is ◎ (better) in total, one with lack of hiding, particle diameter, P ratio are ○ or above and other than those described above is, ○ (good) in total, one with at least one of lack of hiding, particle diameter, P ratio is x, is x (no good) in total.

TABLE 1

(B, Ca, N, O: ppm, Others: mass %)

| Steel kind | C | Si | Mn | P | S | Al | Cr | Mo | Ti | Nb | V | Cu | Ni | B | Ca | N | O | $Ac_1$ (° C.) |
|---|---|---|---|---|---|---|---|---|---|---|---|---|---|---|---|---|---|---|
| 1 | 0.05 | 1.02 | 2.98 | 0.003 | 0.005 | 0.066 | — | — | — | — | — | — | — | — | — | 12 | 16 | 721 |
| 2 | 0.11 | 1.01 | 2.93 | 0.011 | 0.007 | 0.092 | — | — | — | — | — | — | — | — | — | 33 | 8 | 721 |
| 3 | 0.16 | 0.63 | 2.59 | 0.011 | 0.005 | 0.057 | 0.21 | — | — | — | — | — | — | — | — | 17 | 20 | 717 |
| 4 | 0.06 | 0.51 | 1.19 | 0.010 | 0.004 | 0.047 | — | 0.20 | — | — | — | — | — | — | — | 23 | 21 | 725 |
| 5 | 0.08 | 0.65 | 2.10 | 0.009 | 0.003 | 0.052 | — | 0.02 | — | — | — | — | — | — | — | 15 | 32 | 719 |
| 6 | 0.08 | 0.65 | 2.50 | 0.009 | 0.003 | 0.033 | — | 0.10 | — | — | — | — | — | — | — | 26 | 12 | 715 |
| 7 | 0.08 | 0.65 | 2.50 | 0.009 | 0.003 | 0.054 | — | 0.21 | — | — | — | — | — | — | — | 32 | 30 | 715 |
| 8 | 0.09 | 1.12 | 1.88 | 0.005 | 0.001 | 0.032 | — | 0.18 | — | — | — | 0.03 | — | — | — | 23 | 23 | 735 |
| 9 | 0.10 | 1.50 | 2.50 | 0.009 | 0.003 | 0.054 | — | 0.05 | — | — | — | — | 0.03 | — | — | 12 | 28 | 739 |
| 10 | 0.15 | 1.50 | 2.50 | 0.009 | 0.003 | 0.043 | — | 0.21 | — | — | — | — | — | 4 | — | 33 | 19 | 740 |
| 11 | 0.15 | 1.50 | 2.50 | 0.009 | 0.003 | 0.045 | — | 0.49 | — | — | — | — | — | — | — | 34 | 18 | 740 |
| 12 | 0.11 | 1.37 | 1.71 | 0.012 | 0.005 | 0.040 | — | — | 0.009 | — | — | — | — | — | — | 33 | 26 | 745 |
| 13 | 0.08 | 1.13 | 1.91 | 0.009 | 0.006 | 0.520 | 0.02 | — | — | 0.020 | — | — | — | — | — | 71 | 39 | 736 |
| 14 | 0.14 | 0.25 | 1.78 | 0.013 | 0.009 | 0.044 | — | — | — | — | 0.013 | — | — | — | — | 27 | 27 | 711 |
| 15 | 0.13 | 0.20 | 2.19 | 0.006 | 0.002 | 0.082 | — | — | — | — | — | — | — | 9 | — | 15 | 13 | 705 |
| 16 | 0.05 | 0.99 | 2.91 | 0.010 | 0.007 | 0.049 | 0.20 | 0.19 | — | — | — | — | — | — | 15 | 22 | 23 | 724 |
| 17 | 0.16 | 1.11 | 2.32 | 0.009 | 0.002 | 0.087 | — | 0.10 | 0.012 | — | — | — | | — | — | 21 | 19 | 730 |
| 18 | 0.16 | 0.49 | 1.92 | 0.008 | 0.005 | 0.330 | — | 0.05 | — | 0.011 | — | — | — | — | — | 20 | 21 | 717 |
| 19 | 0.15 | 0.25 | 1.88 | 0.013 | 0.011 | 0.044 | — | 0.06 | — | — | 0.011 | — | — | — | — | 27 | 27 | 710 |
| 20 | 0.08 | 0.73 | 2.39 | 0.006 | 0.002 | 0.047 | — | 0.20 | — | — | — | — | — | 13 | — | 15 | 20 | 719 |
| 21 | 0.07 | 0.48 | 1.96 | 0.002 | 0.007 | 0.031 | — | — | 0.021 | 0.036 | — | — | — | — | — | 16 | 9 | 716 |
| 22 | 0.10 | 1.96 | 2.49 | 0.004 | 0.003 | 0.040 | 0.09 | 0.10 | 0.009 | 0.010 | — | — | — | — | — | 23 | 20 | 755 |
| 23 | 0.22 | 0.34 | 1.74 | 0.010 | 0.002 | 2.030 | — | — | — | — | — | 0.20 | 0.14 | — | — | 9 | 15 | 712 |
| 24 | 0.07 | — | 1.94 | 0.009 | 0.006 | 0.011 | — | 0.03 | — | 0.043 | — | — | — | — | 10 | 70 | 35 | 702 |
| 25 | 0.05 | 0.98 | 2.85 | 0.010 | 0.006 | 0.044 | — | 1.02 | — | — | — | — | — | — | — | 22 | 22 | 721 |
| 26 | 0.18 | 1.52 | 2.35 | 0.008 | 0.002 | 0.037 | — | 0.20 | 0.050 | 0.050 | — | 0.30 | 0.20 | — | — | 32 | 17 | 737 |
| 27 | 0.18 | 1.53 | 2.57 | 0.007 | 0.002 | 0.037 | — | — | 0.050 | 0.050 | — | 0.30 | 0.20 | 19 | — | 33 | 16 | 737 |
| 28 | 0.19 | 1.55 | 2.55 | 0.007 | 0.002 | 0.041 | 0.40 | — | 0.050 | 0.050 | — | 0.30 | 0.20 | — | — | 34 | 19 | 744 |
| 29 | 0.22 | 1.49 | 2.65 | 0.008 | 0.002 | 0.042 | — | 0.20 | 0.050 | 0.050 | — | 0.30 | 0.20 | — | — | 38 | 22 | 736 |

$Ac_1 = 723 - 10.7(\%\ Mn) - 16.9(\%\ Ni) + 29.1(\%\ Si) + 16.9(\%\ Cr) + 290(\%\ As) + 6.38(\%\ W)$

TABLE 2

| Producing method No. | Steel kind No. | Producing condition: Finishing temperature (° C.) | Winding temperature (° C.) | Pickling before cold rolling (s) | HeatIng temperature (° C.) | Ultimate slow cooling temperature (° C.) | Cooling method* | Tempering temperature (° C.) | Mechanical property: Yield strength (MPa) | Tensile strength (MPa) | Elongation (%) | Structure (SEM observation) (area %): F | B | M | γ *XDR |
|---|---|---|---|---|---|---|---|---|---|---|---|---|---|---|---|
| 1 | 1 | 900 | 450 | 60 | 870 | 400 | WQ | 200 | 492 | 825 | 23 | 61 | 0 | 39 | 0 |
| 2 | 2 | 900 | 450 | 60 | 870 | 450 | WQ | 500 | 908 | 1045 | 14 | 46 | 0 | 54 | 0 |
| 3 | 2 | 900 | 600 | 60 | 870 | 650 | WQ | 500 | 1120 | 1332 | 9 | 13 | 0 | 87 | 0 |
| 4 | 2 | 900 | 450 | 60 | 870 | 650 | Mist | 500 | 886 | 980 | 14 | 51 | 43 | 0 | 6 |
| 5 | 3 | 900 | 480 | 50 | 850 | 550 | WQ | 200 | 872 | 1272 | 13 | 9 | 0 | 91 | 0 |
| 6 | 4 | 900 | 500 | 40 | 850 | 520 | WQ | 250 | 449 | 603 | 27 | 80 | 0 | 20 | 0 |
| 7 | 5 | 905 | 520 | 40 | 860 | 600 | WQ | 200 | 527 | 781 | 21 | 62 | 0 | 38 | 0 |
| 8 | 6 | 905 | 540 | 40 | 870 | 580 | WQ | 190 | 743 | 892 | 17 | 51 | 0 | 49 | 0 |
| 9 | 7 | 895 | 540 | 40 | 870 | 550 | WQ | 190 | 742 | 1004 | 16 | 42 | 0 | 58 | 0 |
| 10 | 8 | 900 | 510 | 45 | 880 | 630 | RQ | 420 | 425 | 641 | 28 | 75 | 23 | 0 | 2 |
| 11 | 8 | 900 | 510 | 45 | 880 | 630 | WQ | 220 | 550 | 809 | 19 | 59 | 0 | 41 | 0 |
| 12 | 8 | 900 | 510 | 45 | 880 | 630 | Mist | 240 | 504 | 734 | 22 | 63 | 0 | 37 | 0 |
| 13 | 9 | 900 | 650 | 30 | 880 | 700 | RQ | 400 | 544 | 811 | 28 | 52 | 35 | 0 | 13 |
| 14 | 10 | 900 | 550 | 45 | 880 | 600 | RQ | 450 | 786 | 1021 | 17 | 24 | 65 | 0 | 11 |
| 15 | 11 | 900 | 550 | 45 | 880 | 600 | RQ | 450 | 971 | 1245 | 11 | 13 | 77 | 3 | 7 |
| 16 | 12 | 900 | 480 | 50 | 870 | 630 | GJ | 400 | 400 | 630 | 36 | 74 | 19 | 0 | 7 |
| 17 | 13 | 900 | 500 | 50 | 800 | 650 | RQ | 450 | 563 | 714 | 27 | 80 | 16 | 0 | 4 |
| 18 | 14 | 900 | 450 | 60 | 760 | 600 | GJ | 400 | 491 | 650 | 24 | 64 | 36 | 0 | 0 |
| 19 | 15 | 900 | 500 | 60 | 780 | 630 | RQ | 350 | 499 | 652 | 26 | 63 | 37 | 0 | 0 |
| 20 | 16 | 900 | 450 | 60 | 870 | 380 | WQ | 180 | 658 | 997 | 15 | 38 | 0 | 62 | 0 |
| 21 | 17 | 900 | 480 | 50 | 870 | 630 | GJ | 400 | 539 | 833 | 24 | 60 | 31 | 0 | 9 |
| 22 | 18 | 900 | 480 | 50 | 870 | 630 | GJ | 400 | 451 | 784 | 23 | 65 | 30 | 0 | 5 |
| 23 | 19 | 900 | 450 | 60 | 760 | 600 | GJ | 400 | 508 | 681 | 24 | 66 | 34 | 0 | 0 |
| 24 | 20 | 900 | 500 | 50 | 830 | 450 | WQ | 180 | 687 | 1043 | 16 | 35 | 0 | 65 | 0 |
| 25 | 21 | 900 | 450 | 60 | 800 | 630 | GJ | 350 | 492 | 599 | 27 | 82 | 18 | 0 | 0 |
| 28 | 22 | 900 | 480 | 50 | 850 | 500 | WQ | 200 | 938 | 1228 | 11 | 11 | 0 | 89 | 0 |
| 27 | 23 | 893 | 450 | 60 | 850 | 630 | GJ | 400 | 432 | 643 | 33 | 70 | 23 | 0 | 7 |
| 28 | 24 | 900 | 500 | 50 | 800 | 650 | RQ | 450 | 486 | 583 | 24 | 85 | 15 | 0 | 0 |
| 29 | 25 | 880 | 450 | 60 | 870 | 380 | WQ | 250 | 888 | 1111 | 9 | 41 | 59 | 0 | 0 |
| 30 | 26 | 900 | 600 | 50 | 900 | 250 | GJ | 200 | 955 | 1485 | 10 | 4 | 91 | 0 | 5 |
| 31 | 27 | 900 | 650 | 50 | 900 | 250 | GJ | 200 | 938 | 1472 | 10 | 5 | 90 | 0 | 5 |
| 32 | 28 | 900 | 650 | 50 | 900 | 250 | GJ | 200 | 972 | 1491 | 9 | 2 | 93 | 0 | 5 |
| 33 | 29 | 900 | 600 | 50 | 900 | 300 | GJ | 200 | 1060 | 1565 | 9 | 2 | 93 | 0 | 5 |

*WQ: water cooling, RQ: water cooled roll heat reduction, GJ: gas jet cooling, XDR: X-ray diffraction method

TABLE 3

| No. | Producing method No. | Steel kind No. | Acid pickling condition: Hydrochloric acid density (%) | Temperature (° C.) | Dipping time (s) | Load length ratio: tp40 (%) | tp60 (%) | tp60 − tp40 |
|---|---|---|---|---|---|---|---|---|
| 1 | 1 | 1 | 6 | 60 | 10 | 63.8 | 98.3 | 34.5 |
| 2 | 1 | 1 | 15 | 75 | 20 | 23.3 | 94.3 | 71.0 |
| 3 | 1 | 1 | 16 | 75 | 20 | 19.2 | 93.0 | 73.8 |
| 4 | 1 | 1 | 16 | 75 | 40 | 3.4 | 49.7 | 46.3 |
| 5 | 2 | 2 | 15 | 75 | 20 | 8.7 | 89.6 | 80.9 |
| 6 | 3 | 2 | 8 | 75 | 20 | 43.7 | 96.2 | 52.5 |
| 7 | 3 | 2 | 15 | 75 | 20 | 22.1 | 94.3 | 72.2 |
| 8 | 3 | 2 | 15 | 80 | 20 | 12.5 | 76.9 | 64.4 |
| 9 | 3 | 2 | 15 | 85 | 30 | 7.2 | 63.4 | 56.2 |
| 10 | 4 | 2 | 15 | 80 | 35 | 7.7 | 65.0 | 57.3 |
| 11 | 5 | 3 | 15 | 80 | 20 | 9.3 | 84.3 | 75.0 |
| 12 | 6 | 4 | 15 | 70 | 10 | 44.7 | 97.3 | 52.6 |
| 13 | 6 | 4 | 15 | 70 | 20 | 22 | 97.0 | 75.0 |
| 14 | 6 | 4 | 15 | 70 | 30 | 10.9 | 86.6 | 75.7 |
| 15 | 6 | 4 | 15 | 70 | 50 | 4.4 | 55.0 | 50.6 |
| 16 | 7 | 5 | 8 | 80 | 25 | 43.2 | 96.7 | 53.5 |
| 17 | 7 | 5 | 11 | 80 | 25 | 24 | 94.9 | 70.9 |
| 18 | 7 | 5 | 14 | 80 | 25 | 4.4 | 93.3 | 88.9 |
| 19 | 7 | 5 | 18 | 85 | 25 | 3.3 | 45.9 | 42.6 |
| 20 | 8 | 6 | 15 | 80 | 20 | 3.1 | 89.1 | 86.0 |
| 21 | 9 | 7 | 15 | 80 | 20 | 2.7 | 87.9 | 85.2 |
| 22 | 10 | 8 | 14 | 65 | 20 | 43 | 97.3 | 54.3 |

TABLE 3-continued

| | | | | | | | | |
|---|---|---|---|---|---|---|---|---|
| 23 | 10 | 8 | 14 | 75 | 20 | 20.5 | 91.3 | 70.8 |
| 24 | 10 | 8 | 14 | 85 | 20 | 5.5 | 97.2 | 91.7 |
| 25 | 10 | 8 | 14 | 85 | 30 | 0.5 | 56.0 | 55.5 |

| | Average spacing of surface unevenness Sm (μm) | Maximum depth Ry (μm) | Chemical conversion treatment property | | | | |
|---|---|---|---|---|---|---|---|
| No. | | | Lack of hiding (%) | Particle diameter (μm) | P ratio P/P + H | Judgment | Crack |
| 1 | 6.9 | 10.2 | ○ | ○ | ○ | ○ | no |
| 2 | 12.8 | 12.0 | ◎ | ◎ | ◎ | ◎ | no |
| 3 | 10.4 | 18.2 | ◎ | ● | ● | ● | no |
| 4 | 13.2 | 17.3 | ◎ | ◎ | ◎ | ◎ | no |
| 5 | 14.3 | 14.3 | ◎ | ● | ● | ● | no |
| 6 | 7.1 | 11.3 | ○ | ○ | ○ | ○ | yes |
| 7 | 9.8 | 13.2 | ◎ | ◎ | ◎ | ◎ | no |
| 8 | 13.1 | 16.3 | ◎ | ● | ● | ● | no |
| 9 | 12.4 | 14.3 | ◎ | ◎ | ◎ | ◎ | no |
| 10 | 15.3 | 12.7 | ◎ | ◎ | ● | ◎ | no |
| 11 | 13.2 | 12.2 | ◎ | ● | ● | ● | no |
| 12 | 8.4 | 15.8 | X | ○ | X | X | no |
| 13 | 9.3 | 14.2 | ○ | ○ | ○ | ○ | no |
| 14 | 7.8 | 11.6 | ◎ | ◎ | ◎ | ◎ | no |
| 15 | 11.1 | 10.1 | ◎ | ○ | ○ | ○ | no |
| 16 | 9.1 | 11.4 | X | ○ | ○ | X | no |
| 17 | 9.3 | 13.2 | ◎ | ○ | ◎ | ○ | no |
| 18 | 7.7 | 10.7 | ◎ | ◎ | ◎ | ◎ | no |
| 19 | 7.9 | 12.2 | ◎ | ○ | ○ | ○ | no |
| 20 | 13.2 | 14.3 | ◎ | ◎ | ◎ | ◎ | no |
| 21 | 9.1 | 15.7 | ◎ | ◎ | ◎ | ◎ | no |
| 22 | 15.8 | 8.4 | X | ○ | ○ | X | no |
| 23 | 13.2 | 12.1 | ○ | ○ | ○ | ○ | no |
| 24 | 13.7 | 16.6 | ◎ | ◎ | ● | ◎ | no |
| 25 | 11.8 | 14.2 | ○ | ○ | ◎ | ○ | no |

TABLE 4

| | | | Acid pickling condition | | | Load length ratio | | |
|---|---|---|---|---|---|---|---|---|
| No. | Producing method No. | Steel kind No. | Hydrochloric acid density (%) | Temperature (° C.) | Dipping time (s) | tp40 (%) | tp60 (%) | tp60 − tp40 |
| 26 | 11 | 8 | 15 | 80 | 20 | 6.1 | 96.3 | 90.2 |
| 27 | 12 | 8 | 15 | 80 | 20 | 7.9 | 88.4 | 80.5 |
| 28 | 13 | 9 | 5 | 80 | 10 | 77.3 | 99.9 | 22.6 |
| 29 | 13 | 9 | 15 | 80 | 10 | 38.2 | 97.7 | 59.5 |
| 30 | 13 | 9 | 15 | 80 | 18 | 29.9 | 99.9 | 70.0 |
| 31 | 13 | 9 | 15 | 80 | 25 | 0.5 | 86.4 | 85.9 |
| 32 | 13 | 9 | 15 | 80 | 40 | 0.5 | 44.2 | 43.7 |
| 33 | 14 | 10 | 15 | 80 | 20 | 0.9 | 97.1 | 96.2 |
| 34 | 15 | 11 | 15 | 80 | 20 | 2.4 | 93.9 | 91.5 |
| 35 | 16 | 12 | 13 | 85 | 20 | 8.8 | 79.3 | 70.5 |
| 36 | 17 | 13 | 13 | 70 | 40 | 15.3 | 87.9 | 72.6 |
| 37 | 18 | 14 | 13 | 70 | 25 | 28.3 | 98.5 | 70.2 |
| 38 | 19 | 15 | 18 | 65 | 20 | 23.5 | 97.9 | 74.4 |
| 39 | 20 | 16 | 18 | 90 | 22 | 2.3 | 44.0 | 41.7 |
| 40 | 21 | 17 | 15 | 80 | 20 | 5.5 | 87.9 | 82.4 |
| 41 | 22 | 18 | 15 | 80 | 20 | 3.3 | 76.3 | 73.0 |
| 42 | 23 | 19 | 15 | 80 | 15 | 23.2 | 94.3 | 71.1 |
| 43 | 24 | 20 | 15 | 80 | 15 | 20.1 | 91.3 | 71.2 |
| 44 | 25 | 21 | 15 | 80 | 20 | 15.4 | 96.4 | 81.0 |
| 45 | 26 | 22 | 15 | 80 | 20 | 17.3 | 92.0 | 74.7 |
| 46 | 26 | 22 | 14 | 70 | 20 | 33.3 | 99.9 | 66.6 |
| 47 | 27 | 23 | 11 | 80 | 20 | 38.8 | 99.5 | 60.7 |
| 48 | 27 | 23 | 11 | 60 | 20 | 39.7 | 99.7 | 60.0 |
| 49 | 28 | 24 | 16 | 87 | 25 | 1.3 | 54.3 | 53.0 |
| 50 | 29 | 25 | 15 | 80 | 20 | 15.2 | 97.3 | 82.1 |

TABLE 4-continued

| | | | | | | | | |
|---|---|---|---|---|---|---|---|---|
| 51 | 30 | 26 | 15 | 80 | 25 | 2.1 | 92.3 | 90.2 |
| 52 | 31 | 27 | 15 | 80 | 25 | 5.7 | 89.8 | 83.1 |
| 53 | 32 | 28 | 15 | 80 | 25 | 4.9 | 88.4 | 83.5 |
| 54 | 33 | 29 | 15 | 80 | 25 | 3.8 | 86.4 | 82.6 |

| | | | Chemical conversion treatment property | | | | |
|---|---|---|---|---|---|---|---|
| No. | Average spacing of surface unevenness Sm (μm) | Maximum depth Ry (μm) | Lack of hiding (%) | Particle diameter (μm) | P ratio P/P + H | Judgment | Crack |
| 26 | 12.3 | 11.8 | ◎ | ◎ | ? | ◎ | no |
| 27 | 17.0 | 12.0 | ◎ | ◎ | ◎ | ◎ | no |
| 28 | 13.1 | 11.1 | X | ○ | X | X | yes |
| 29 | 10.9 | 12.7 | X | X | ○ | X | yes |
| 30 | 12.1 | 12.3 | ◎ | ○ | ○ | ○ | no |
| 31 | 13.8 | 16.4 | ◎ | ◎ | ◎ | ◎ | no |
| 32 | 10.0 | 10.7 | ◎ | ○ | ○ | ○ | no |
| 33 | 8.0 | 13.7 | ◎ | ◎ | ◎ | ◎ | no |
| 34 | 7.9 | 10.2 | ◎ | ◎ | ◎ | ◎ | no |
| 35 | 13.8 | 11.3 | ◎ | ? | ? | ? | no |
| 36 | 12.1 | 14.0 | ◎ | ? | ? | ? | no |
| 37 | 14.6 | 12.0 | ◎ | ◎ | ◎ | ◎ | no |
| 38 | 10.2 | 12.4 | ◎ | ◎ | ◎ | ◎ | no |
| 39 | 10.9 | 12.3 | ○ | ○ | ◎ | ○ | no |
| 40 | 12.5 | 16.3 | ◎ | ◎ | ◎ | ◎ | no |
| 41 | 13.4 | 14.3 | ◎ | ◎ | ? | ◎ | no |
| 42 | 12.4 | 14.9 | ◎ | ○ | ○ | ○ | no |
| 43 | 8.9 | 13.7 | ◎ | ○ | ○ | ○ | no |
| 44 | 12.9 | 12.5 | ◎ | ? | ? | ? | no |
| 45 | 9.3 | 11.3 | ◎ | ◎ | ◎ | ◎ | no |
| 46 | 30.1 | 11.8 | X | ○ | ○ | X | no |
| 47 | 11.7 | 10.3 | ◎ | ◎ | ? | ◎ | no |
| 48 | 20.3 | 9.3 | ○ | X | ○ | X | no |
| 49 | 14.8 | 16.4 | ◎ | ◎ | ◎ | ◎ | no |
| 50 | 12.6 | 13.6 | X | X | ○ | X | no |
| 51 | 9.3 | 11.3 | ◎ | ◎ | ◎ | ◎ | no |
| 52 | 10.2 | 10.9 | ◎ | ◎ | ◎ | ◎ | no |
| 53 | 11.2 | 11.6 | ◎ | ◎ | ◎ | ◎ | no |
| 54 | 13.1 | 12.2 | ◎ | ◎ | ◎ | ◎ | no |

From Tables 1-4 exhibited above, it is possible to consider as follows.

Although Experiment Nos. 1, 6 are comparative examples wherein both tp40 and (tp60-tp40) of load length ratio are deviated from the stipulated required condition of the present invention, extreme deterioration of chemical conversion treatment property is not recognized because Mo is not added.

Because Mo is included in the steel material in Experiment Nos. 12, 16 and both tp40 and (tp60-tp40) of load length ratio are deviated from the stipulated required condition of the present invention, chemical conversion treatment property inhibiting action by Mo appears extremely, and both are poor in chemical conversion treatment property.

Because both tp40 and (tp60-tp40) of load length ratio in Experiment No. 22 are deviated from the stipulated required condition of the present invention and the maximum depth Ry of the unevenness of the surface does not reach the stipulated value, chemical conversion treatment property is poor.

Because both tp40 and (tp60-tp40) of load length ratio in Experiment Nos. 28, 29 are deviated from the stipulated required condition of the present invention and narrow and deep crack exists on the surface, chemical conversion treatment property is poor.

Because the average spacing Sm of the unevenness of the surface in Experiment No. 46 exceeds the stipulated value, and the maximum depth Ry of the unevenness of the surface in Experiment No. 48 does not reach the stipulated value, both are poor in chemical conversion treatment property. Also, in Experiment No. 50, although the surface property of the steel sheet is good, Mo content in steel is excessive, therefore chemical conversion treatment property is poor.

Contrary to them, in ones other than the pointed out examples described above, not only the steel kind with Mo not being added but also the one with Mo of an appropriate amount being added for high strengthening satisfy the stipulated required conditions of the surface property stipulated in the present invention, therefore all have secured excellent chemical conversion treatment property.

The invention claimed is:

1. A cold rolled steel sheet wherein a maximum depth (Ry) of unevenness existing on the surface of the steel sheet is 10 μm or more, a average spacing (Sm) of unevenness is 30 μm or less, a load length ratio (tp40) of unevenness of the surface is 20% or less, and a crack of 3 μm or less width and 5 μm or more depth does not exist, wherein the steel sheet satisfies C:0.05-1.0 wt %, Si:2.0 wt % or less, Mn:0.3-4.0 wt %, Al:0.005-3.0 wt %, the balance is substantially iron, wherein a metal structure is a two-phase structure of ferrite and tempered martensite, and the tensile strength is 780 MPa or above.

2. A cold rolled steel sheet wherein a maximum depth (Ry) of unevenness existing on the surface of the steel sheet is 10 μm or more, a average spacing (Sm) of unevenness is 30 μm or less, a difference of the load length ratios (tp60) and (tp40)

of unevenness of the surface is 60% or more, and a crack of 3 μm or less width and 5 μm or more depth does not exist, wherein the steel sheet satisfies C:0.05-1.0 wt %, Si:2.0 wt % or less, Mn:0.3-4.0 wt %, Al:0.005-3.0 wt %, the balance is substantially iron, wherein a metal structure is a two-phase structure of ferrite and tempered martensite, and the tensile strength is 780 MPa or above.

3. A cold rolled steel sheet wherein a maximum depth (Ry) of unevenness existing on the surface of the steel sheet is 10 pm or more, a average spacing (Sm) of unevenness is 30 μm or less, a load length ratio (tp40) of unevenness of the surface is 20% or less, a difference of the load length ratios (tp60) and (tp40) of the surface is 60% or more, and a crack of 3 μm or less width and 5 μm or more depth does not exist, wherein the steel sheet satisfies C:0.05-1.0 wt %, Si:2.0 wt % or less, Mn:0.3-4.0 wt %, Al:0.005-3.0 wt %, the balance is substantially iron, wherein a metal structure is a two-phase structure of ferrite and tempered martensite, and the tensile strength is 780 MPa or above.

4. The cold rolled steel sheet as set forth in claim 1, wherein the steel sheet further comprises Mo:0.02-1.0 wt %.

5. The cold rolled steel sheet as set forth in claim 1, wherein the steel sheet further comprises at least one element selected from a group consisting of:

Cr:1.0 wt % or less,
Ti:0.2 wt % or less,
Nb:0.1 wt % or less,
V:0.1 wt % or less,
Cu:1.0 wt % or less,
Ni:1.0 wt % or less,
B:0.002 wt % or less,
Ca:0.005 wt % or less.

6. The cold rolled steel sheet as set forth in claim 1, wherein the chemical component satisfies Si:0.1-2.0 wt %, Al:0.01-3.0 wt %, (Si+Al):1.0-4.0 wt %, the metal structure has a complex structure of 5-80 area % ferrite, 5-80 area % bainite, the total amount of ferrite and bainite is 75 area % or more, a retained austenite is 5 area % or more.

7. The cold rolled steel sheet as set forth in claim 1, wherein the concentration of C ranges from 0.05-0.23 wt %.

8. The cold rolled steel sheet as set forth in claim 1, wherein the concentration of Si ranges from 0.1 to 1.5 wt %.

9. The cold rolled steel sheet as set forth in claim 1, wherein the concentration of Mn ranges from 0.5-2.5 wt %.

10. The cold rolled steel sheet as set forth in claim 1, wherein the concentration of Al ranges from 0.01-2.0 wt %.

11. The cold rolled steel sheet as set forth in claim 2, wherein the steel sheet further comprises Mo:0.02-1.0 wt %.

12. The cold rolled steel sheet as set forth in claim 2, wherein the steel sheet further comprises at least one element selected from a group consisting of:

Cr:1.0 wt % or less,
Ti:0.2 wt % or less,
Nb:0.1 wt % or less,
V:0.1 wt % or less,
Cu:1.0 wt % or less,
Ni:1.0 wt % or less,
B:0.002 wt % or less,
Ca:0.005 wt % or less.

13. The cold rolled steel sheet as set forth in claim 2, wherein the chemical component satisfies Si:0.1-2.0 wt %, Al:0.01-3.0 wt %, (Si+Al):1.0-4.0 wt %, the metal structure has a complex structure of 5-80 area % ferrite, 5-80 area % bainite, the total amount of ferrite and bainite is 75 area % or more, the retained austenite is 5 area % or more.

14. The cold rolled steel sheet as set forth in claim 2, wherein the concentration of C ranges from 0.05-0.23 wt %.

15. The cold rolled steel sheet as set forth in claim 2, wherein the concentration of Si ranges from 0.1 to 1.5 wt %.

16. The cold rolled steel sheet as set forth in claim 2, wherein the concentration of Mn ranges from 0.5-2.5 wt %.

17. The cold rolled steel sheet as set forth in claim 2, wherein the concentration of Al ranges from 0.01-2.0 wt %.

18. The cold rolled steel sheet as set forth in claim 3, wherein the steel sheet further comprises Mo:0.02-1.0 wt %.

19. The cold rolled steel sheet as set forth in claim 3, wherein the steel sheet further comprises at least one element selected from a group consisting of:

Cr:1.0 wt % or less,
Ti:0.2 wt % or less,
Nb:0.1 wt % or less,
V:0.1 wt % or less,
Cu:1.0 wt % or less,
Ni:1.0 wt % or less,
B:0.002 wt % or less,
Ca:0.005 wt % or less.

20. The cold rolled steel sheet as set forth in claim 3, wherein the chemical component satisfies Si:0.1-2.0 wt %, Al:0.01-3.0 wt %, (Si+Al):1.0-4.0 wt %, the metal structure has a complex structure of 5-80 area % ferrite, 5-80 area % bainite, the total amount of ferrite and bainite is 75 area % or more, the retained austenite is 5 area % or more.

21. The cold rolled steel sheet as set forth in claim 3, wherein the concentration of C ranges from 0.05-0.23 wt %.

22. The cold rolled steel sheet as set forth in claim 3, wherein the concentration of Si ranges from 0.1 to 1.5 wt %.

23. The cold rolled steel sheet as set forth in claim 3, wherein the concentration of Mn ranges from 0.5-2.5 wt %.

24. The cold rolled steel sheet as set forth in claim 3, wherein the concentration of Al ranges from 0.01-2.0 wt %.

* * * * *